United States Patent [19]

Brenner et al.

[11] 4,128,210

[45] Dec. 5, 1978

[54] FOOD WASTE DISPOSAL APPARATUS

[75] Inventors: Robert A. Brenner, St. Joseph; Victor W. Cuthbert, Sodus; Albert T. Braga, Stevensville, all of Mich.

[73] Assignee: Whirlpool Corporation, Benton Harbor, Mich.

[21] Appl. No.: 781,009

[22] Filed: Mar. 24, 1977

[51] Int. Cl.[2] ..... B02C 18/40

[52] U.S. Cl. ..... 241/46 R; 241/100.5

[58] Field of Search ..... 241/46, 46 A, 46 B, 241/100.5, 257 G

[56] References Cited

U.S. PATENT DOCUMENTS

| | | | |
|---|---|---|---|
| 2,772,836 | 12/1956 | Gebhart | 241/100.5 |
| 2,828,083 | 3/1958 | Macemon | 241/46 |
| 3,071,329 | 1/1963 | Shell et al. | 241/46 |
| 3,165,270 | 1/1965 | Stout et al. | 241/46 B |
| 3,236,462 | 2/1966 | Stout | 241/60 |

*Primary Examiner*—Granville Y. Custer, Jr.

*Attorney, Agent, or Firm*—Wegner, Stellman, McCord, Wiles & Wood

[57] ABSTRACT

A food waste disposal apparatus having an improved effluent recirculating structure for facilitating dislodging of waste material which may become lodged in the comminuting portion of the disposer. The recirculating structure includes a tubular wall member having a plurality of openings to the grinding chamber above the cutter-impeller structure. The tubular wall member is spaced inwardly of the housing to define therebetween an annular flow space for conducting a portion of the effluent delivered from the cutter-impeller outwardly to and inwardly through the wall member openings to provide the desired waste dislodging recirculation of the effluent.

14 Claims, 5 Drawing Figures

FOOD WASTE DISPOSAL APPARATUS

BACKGROUND OF THE INVENTION

1. Field of the Invention

This invention relates to waste disposers and in particular to food waste disposers having cutter-impeller means for comminuting waste in a grinding chamber and delivering the comminuted waste in the form of an effluent to an outlet.

2. Description of the Prior Art

One conventional form of food waste disposer is shown in U.S. Pat. No. 3,151,815 of Edward L. Ohime, which patent is owned by the assignee hereof. As shown therein, a cutting wheel is driven about a vertical axis at the lower end of a grinding chamber by an electric drive motor. The cutter wheel is provided with an upstanding cutter-impeller which cooperates with a shredder ring having a plurality of downwardly opening notches in its lower edge to comminute waste material delivered to the grinding chamber. The comminuted waste material is delivered from the grinding chamber in the form of an effluent by the mixing thereof in a suitable quantity of water delivered downwardly to the grinding chamber concurrently with the delivery of the waste material. The effluent may be discharged from the waste disposer through a suitable waste line, as desired.

Notwithstanding the delivery of water with the waste material to the grinding chamber, at times a portion of the waste material may become lodged in different portions of the structure. Such lodging of the waste material reduces the efficiency of the disposal operation and presents an undesirable condition from the point of view of sanitation and odorfree operation of the device.

A number of the other comminuting and disposal devices have been developed for use with food materials. Illustratively, William H. Taylor, in U.S. Pat. No. 2,637,359, shows a meat chopper utilizing a foraminous screen through which the meat is forced in the operation of the device.

Herbert J. Macemon, in U.S. Pat. No. 2,828,083, shows a waste disposal apparatus wherein a shredder ring is provided having a row of apertures at the upper end thereof for delivering water from the grinding chamber outwardly therethrough and thereby maintain a preselected maximum level of water in the grinding chamber. As discussed by Macemon, the level of the apertures is preselected to provide the desired level corresponding to an optimum supply of water in the grinding chamber during the grinding operation. Macemon teaches that the total area of the apertures should be large enough to discharge water at a rate high enough to preclude building up of a layer of water on the cutter wheel under normal operating conditions. Macemon teaches that the apertures provide a flow of water down the outer surfaces of the shredding ring so as to maintain the outer surface free of waste material and prevent clogging of the space around the downwardly opening notches. The Macemon apertures are circular in cross section.

Hans Jordan, in U.S. Pat. No. 2,912,176, shows a waste disposal apparatus having a free-swinging impeller with the shredding wall member including inwardly projecting teeth and elongated ribs.

In the food waste disposer of George R. Coss, disclosed in U.S. Pat. No. 2,939,639, a plurality of teeth are provided on the inner surface of the shredder ring to provide a threading-down effect.

Hans Jordan, in U.S. Pat. No. 2,940,677, shows a disposal device having a plurality of lugs projecting inwardly from the inner surface of the shredder ring.

In U.S. Pat. No. 3,071,329 of Ernest F. Shell et al., a food waste disposer is shown having upper apertures through which the effluent is impelled outwardly to an annular drain space substantially in the manner taught by Macemon, as discussed above.

Rolla J. Stout, in U.S. Pat. No. 3,236,462, shows a waste disposer having upper perforations through which the comminuted waste material passes to the outer annular drain passage. The inner surface of the shredder ring is provided with a plurality of elongated lugs extending diagonally therealong. The annular space around the shredder ring is substantially enlarged to assure free flow of the effluent outwardly through all of the apertures to the discharge.

SUMMARY OF THE INVENTION

The present invention comprehends an improved waste disposer having means for recirculating effluent through the grinding chamber to provide improved dislodging of waste material which may become lodged on portions of the structure in the normal operation thereof.

More specifically, the present invention comprehends the provision of an improved shredder element associated with the housing of the disposer so as to cause a portion of the effluent discharged by the cutter impeller to be recirculated upwardly and back into the grinding chamber through a plurality of upper openings in the shredder.

The normal discharge of the waste-water effluent is through a plurality of downwardly opening, relatively large cross section notches. The forceful impingement of the effluent against the wall of the housing closely outwardly of the notches causes a portion of the water to flow upwardly through an annular space between the housing and the outer surface of the annular shredder ring.

The upper portion of the shredder ring is provided with a plurality of arrays of elongated openings which, in the illustrated embodiment comprise rectangular openings arranged at an angle to the vertical axis of the disposer. Thus, in the present invention, the upper openings function to deliver the outwardly flowed effluent from the annular space and inwardly through the upper openings back into the grinding chamber for recirculation therein and improved dislodging of lodged waste material.

Thus, the structure of the present invention is arranged to function substantially differently from the prior art structures wherein upper openings are provided in shredder rings for passing outwardly a portion of the water from the grinding chamber for any one of a number of different purposes.

In the present invention, a number of the upper openings may also be disposed radially outwardly of the cutter-impeller of the comminuting means so that a portion of the effluent may also be discharged outwardly therethrough to flow upwardly through the annular space to the upper openings and then inwardly therethrough to recirculate in the grinding chamber.

In the illustrated embodiment, the openings are rectangular with the elongated direction of the openings extending at an angle of approximately 60° to the vertical axis of the disposer.

The openings may have a length slightly greater than the vertical height of the downwardly opening notches.

In the illustrated embodiment, the openings comprise rectangular openings having dimensions of approximately $\frac{1}{8}$ by $\frac{3}{8}$ inch.

The openings may be arranged in horizontal, vertically spaced arrays.

Thus, the present invention comprehends an improved waste disposer structure wherein a recirculation of a portion of the effluent is utilized to provide improved, self-cleaning action for effectively minimizing maintenance requirements and maintaining the waste disposer effectively free of retained lodged material. This structure is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
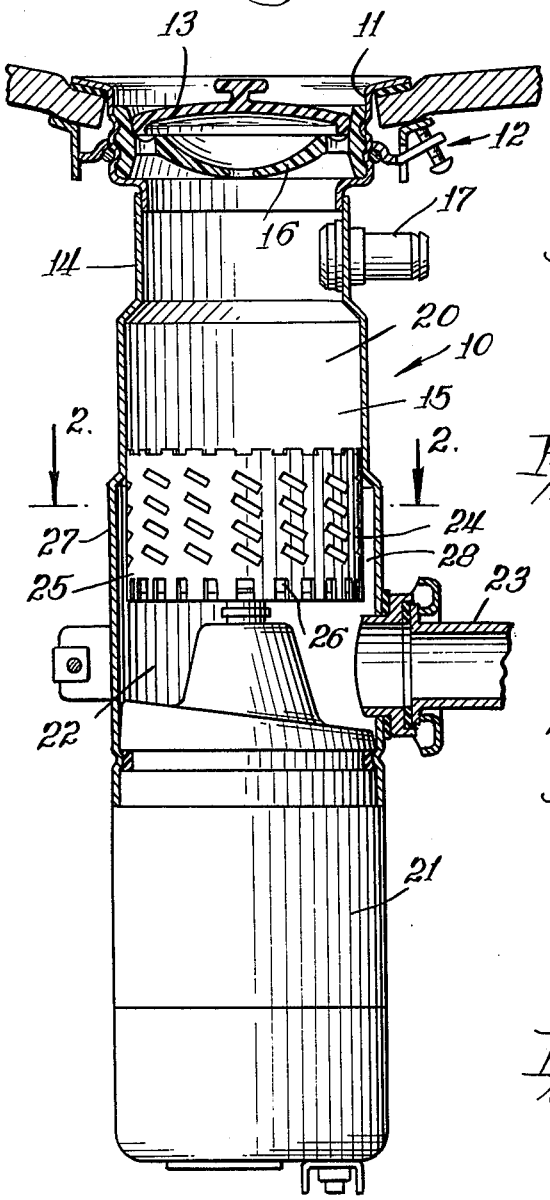
FIG. 1 is a vertical section of an installation of a waste disposer embodying the invention.

In the exemplary embodiment of the invention as disclosed in the drawing, a food waste disposer generally designated 10 is adapted to be mounted in a sink drain opening 11 by means of a locking assembly generally designated 12. The disposer may be provided with a removable cover 13 for selectively closing the disposer when not in use.

The disposer includes a generally tubular housing 14 defining a mixing chamber 15 which is yieldably closed at its upper end by a rubber slit closure 16. A fluid inlet 17 may be provided in the upper portion of the housing.

At the lower end of the grinding chamber 15, the disposer is provided with a cutter wheel 18 having an upstanding cutter-impeller 19. The cutter wheel is rotatable about a vertical axis 20 by a suitable electric motor 21 secured to the lower end of the housing 14. In the illustrated embodiment, the motor 21 is a high speed motor developing an output shaft rotation of approximately 11,000 rpm for improved comminuting of the waste material by the disposer.

Below the cutter wheel, the housing defines a discharge chamber 22 provided with a discharge outlet 23 for delivering the waste to a suitable waste line, as desired.

Comminuting of the waste material in grinding chamber 15 is effected by the high speed rotation of the cutter-impeller in cooperation with a shredder ring 24 having a lower portion 25 provided with a plurality of downwardly opening notches 26. In moving past the notches as a result of the rotation of the cutter wheel 18, the cutter-impeller cooperates with the edges of the notches 26 to shred, or cut, the waste material. At the same time, the cutter-impeller urges the resultant wastewater effluent outwardly through the notches 26 for discharge thereof through the discharge chamber 22 and outlet 23.

In the illustrated embodiment, the housing 14 is provided with an enlarged portion 27 outwardly of the shredder ring and extending outwardly and downwardly therefrom. An annular space 28 is thus defined between the outer surface 29 of the shredder ring 24 and the inner surface 30 of the housing portion 27.

Figure 2:
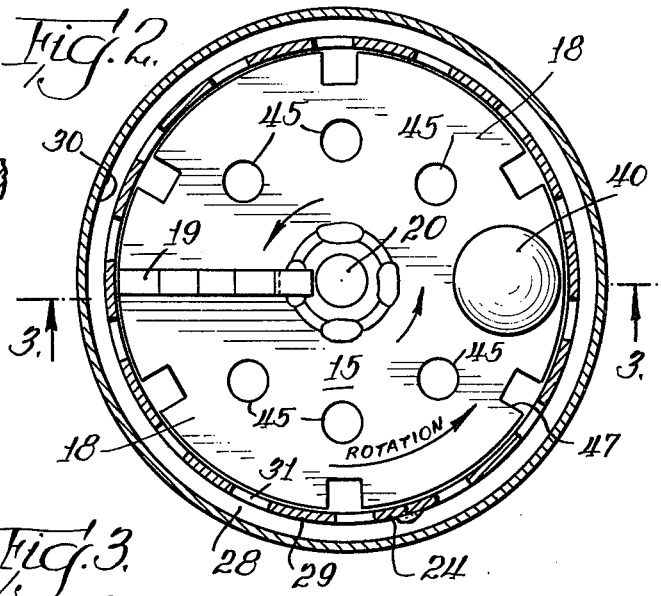
FIG. 2 is an enlarged cross section thereof taken substantially along the line 2—2 of FIG. 1.
Figure 3:
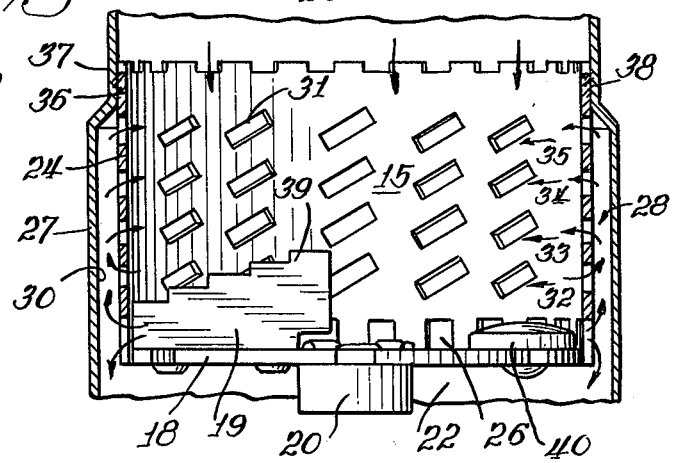
FIG. 3 is a fragmentary vertical section taken substantially along the line 3—3 of FIG. 2.

As best seen in FIGS. 1, 2 and 3, the annular space is relatively thin so that the housing wall 27 is closely spaced outwardly of the notches 26 whereby the impelled effluent is directed substantially against the wall at that point. Resultingly, a first portion of the effluent is discharged downwardly to the discharge chamber 22, as discussed above, but concurrently, a second portion of the effluent is urged upwardly through the annular space 28.

As further seen in FIGS. 1 and 3, the shredder ring 24 is further provided with a plurality of openings 31 spaced above the downwardly opening notches 26 and distributed about the annular shredded ring. In the illustrated embodiment, the openings 31 are arranged in a plurality of horizontally extending, vertially spaced arrays 32, 33, 34 and 35.

Figure 4:
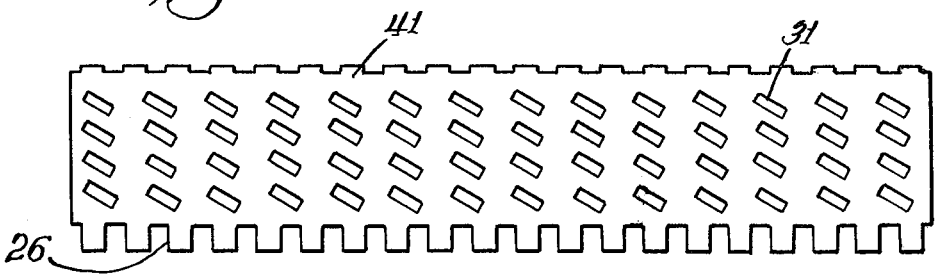
FIG. 4 is an elevation of the shredder ring prior to the formation thereof in annular form.

In the illustrated embodiment, the openings 31 are elongated, and more specifically, as seen in FIGS. 3 and 4, are rectangular. As further shown therein, the openings are arranged to a substantial angle to the vertical axis 20 of the disposer and illustratively may be disposed at an angle of approximately 60° thereto.

In one form of disposer embodying the invention, the openings were approximately $\frac{1}{8} \times \frac{3}{8}$ inch with the notches being approximately 0.2 inch wide and approximately 0.3 inch high. The arrays were spaced apart approximately 0.03 inch with the bottom array 32 being spaced above the bottom edge of the shredder ring approximately 0.44 inch. The shredder ring had an outside diameter of approximately 3.12 inches and a height of approximately 2 inches.

As seen in FIG. 3, the upper end 36 of the shredder ring may be secured to the housing at a portion 37 immediately above the portion 27 as by spot welding 38. Thus, the shredder ring is fixedly secured in substantially coaxial relationship to the cutter wheel with the notches 26 being disposed radially outwardly of the cutting wheel and the lower portion of the cutter-impeller 19.

As further shown in FIG. 3, the cutter-impeller 19 extends upwardly from the wheel 18 sufficiently to have an upper portion 39 thereof disposed radially inwardly of the lowermost array 32 of openings 31. Thus, as shown in FIG. 3, the effluent may be urged outwardly through the lowermost openings of array 32 concurrently with the outward movement of the effluent through notches 26 to provide an enhanced upward flow of the effluent through the annular space 28.

As shown by the arrows in FIG. 3, the upwardly moving effluent is discharged radially inwardly through the upper openings of arrays 33, 34 and 35 so as to be recirculated in the grinding chamber 15 for dislodging waste material which may have become lodged on the different surfaces thereof in the operation of the disposer. It has been found that such recirculation effectively maintains the comminuting portion of the disposer relatively free of lodged material thereby permitting effectively minimized maintenance while yet maintaining the disposer sanitary and odorfree.

The recirculation of the effluent further comminutes material which is thusly recirculated and impelled by cutter-impeller 19 for a further improved comminuting of the waste material prior to the delivery to discharge chamber 22 and outlet 23 thereby providing a further improved operation of the disposer.

In the illustrated embodiment, the motor 21 rotates the cutter wheel 18 in a counterclockwise direction, as seen in FIGS. 2 and 3, so that the rectangular openings 31 are effectively downwardly inclined in the direction of rotation of the cutter-impeller. As shown in FIG. 3, the cutter-impeller may be counterbalanced by a suitable counterweight 40 to balance the rotating mass at the relatively high speed provided by the motor.

The shredder ring 24 may be formed from a flat sheet of metal 41, as shown in FIG. 4, by perforating the sheet to define the openings 31 and notches 26. The sheet may then be bent to annular form by suitable apparatus and the opposite ends spot welded together to define the desired annular shredder ring 24.

Figure 5:
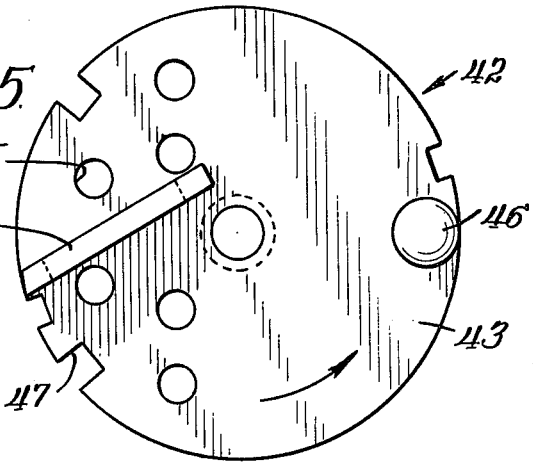
FIG. 5 is a top plan view of the cutter wheel carrying the cutter-impeller means.

In FIG. 5, a modified form of comminuting means generally designated 42 is shown to comprise a cutter plate 43 having a cutter-impeller 44 mounted to the plate at an angle to the radius. Each of cutter plates 18 and 43 may be provided with a plurality of openings 45. Cutter wheel 43 may be provided with a counterweight 46. Liquid is discharged from the grinding chamber 15 through the openings 45 into the discharge chamber 22, and openings 45 also cooperate with the respective counterweights to assist in the balancing of the rotating mechanism.

As further shown in each of FIGS. 2 and 5, the cutter wheel may be provided with a plurality of peripheral radially outwardly opening notches 47 for further cooperating with the notches 26 of the shredder ring in comminuting the waste material.

Thus, the food waste disposer 10 provides an improved self-cleaning comminution of waste material in a novel and simple manner. The recirculation of a portion of the effluent is effected as a normal concomitant of the disposer operation and, thus, is automatically provided without the need for expensive and complicated apparatus.

The foregoing disclosure of specific embodiments is illustrative of the broad inventive concepts comprehended by the invention.

The embodiments of the invention in which an exclusive property or privilege is claimed are defined as follows:

1. In a waste disposer having a tubular housing wall partially defining a grinding chamber, a cutter wheel having a cutter-impeller, means for rotating the cutter wheel about a vertical axis at a lower portion of the grinding chamber at a high speed such as in the order of 11,000 rpm, a lower outlet from the housing, and a tubular wall member fixed in said grinding chamber substantially coaxially of said cutter wheel and having lower openings adjacent said cutter wheel for cooperating therewith in cutting waste delivered downwardly with mixing water into said grinding chamber onto said cutter wheel, said wall member having an outer diameter of approximately 3 inches and being smaller than the diameter of the housing wall to define a downwardly opening thin annular space therebetween, said wall member further defining a plurality of upper openings spaced less than approximately 2 inches above the bottom of the wall member, the improvement comprising the construction of said openings, said wall member, said housing wall portion and the rotated cutter-impeller to cooperatively effectively define means for providing a sufficiently forceful flow of the cut waste and water effluent effectively outwardly through said lower openings and impingement against said outwardly adjacent portion of said housing wall to cause concurrently a first portion of the effluent to be diverted upwardly through said annular space and cause at least a portion of the upwardly diverted effluent to be effectively pumped inwardly through said upper openings for recirculation in said grinding chamber to cause dislodging of lodged waste on the inner surface of said wall member.

2. The waste disposer of claim 1 wherein said wall member is fixedly secured to said housing wall.

3. The waste disposer of claim 1 wherein said wall member is secured to said housing wall.

4. The waste disposer of claim 1 wherein said upper openings are elongated.

5. The waste disposer of claim 1 wherein said upper openings are elongated and inclined to said cutter wheel axis.

6. The waste disposer of claim 1 wherein said upper openings are rectangular.

7. The waste disposer of claim 1 wherein a portion of said upper openings are disposed outwardly adjacent said cutter-impeller to pass a third portion of the effluent outwardly therethrough and against a second outwardly adjacent portion of said housing wall to recirculate with said second portion of the effluent.

8. In a waste disposer having a housing wall partially defining a grinding chamber, a cutter wheel having a cutter-impeller fixedly carried thereon, means for rotating the cutter wheel about a vertical axis at a lower portion of the grinding chamber at a high speed such as in the order of 11,000 rpm, a lower outlet from the housing, and a tubular wall member fixed in said grinding chamber substantially coaxially of said cutter wheel and having lower downwardly opening notches adjacent said cutter wheel for cooperating therewith in cutting waste delivered downwardly with mixing water into said grinding chamber onto said cutter wheel, said wall member having an outer diameter of approximately 3 inches, said wall member diameter being substantially smaller than the diameter of the housing wall to define a downwardly opening thin annular space therebetween, said wall member defining a plurality of upper openings spaced substantially above said notches a distance of less than approximately 2 inches, and said housing wall defining a portion outwardly adjacent said notches, the improvement comprising the construction of said notches, said openings, said wall member, said housing wall portion and the rotated cutter-impeller to cooperatively effectively define means for providing a sufficiently forceful flow of the cut waste and water effluent effectively outwardly through said notches and impingement against said outwardly adjacent portion of said housing wall to cause concurrently a first portion of the effluent to be diverted downwardly to said outlet and a second portion of effluent to be diverted upwardly through said annular space and cause at least a portion of the upwardly diverted effluent to be effectively pumped inwardly through said upper openings for recirculation in said grinding chamber and dislodging of lodged waste on the inner surface of said wall member.

9. The waste disposer of claim 8 wherein said tubular wall member defines smooth cylindrical inner and outer surfaces through which said openings and notches open.

10. The waste disposer of claim 8 wherein the elongate direction of said openings is at an angle of approximately 60° to said vertical axis.

11. The waste disposer of claim 8 wherein said upper openings comprise parallel, vertically spaced annular arrays of openings.

12. The waste disposer of claim 8 wherein said openings have a length slightly greater than the vertical height of said notches.

13. The waste disposer of claim 8 wherein said notches have a cross-sectional area substantially greater than that of said openings.

14. The waste disposer of claim 8 wherein said openings comprise rectangular openings approximately $\frac{1}{8}$ inch by $\frac{3}{8}$ inch.

* * * * *